US006153563A

United States Patent [19]

Smith et al.

[11] Patent Number: 6,153,563

[45] Date of Patent: Nov. 28, 2000

[54] POUCHED INGREDIENTS FOR PREPARING GREASES

[75] Inventors: W. Novis Smith; Joel McCloskey, both of Philadelphia, Pa.; Andrew Atterbury, Anaheim, Calif.

[73] Assignee: Lithchem International, Anaheim, Calif.

[21] Appl. No.: 09/437,851

[22] Filed: Nov. 10, 1999

[51] Int. Cl.[7] ..... C10M 113/16; B29D 22/00

[52] U.S. Cl. ..... 508/154; 508/178; 508/534; 508/539; 528/35.2; 528/35.5; 528/523

[58] Field of Search ..... 508/154, 534, 508/539; 428/178, 35.2, 35.5, 523

[56] References Cited

U.S. PATENT DOCUMENTS

| | | | |
|---|---|---|---|
| 3,728,261 | 4/1973 | Mitacek | 508/534 |
| 3,850,823 | 11/1974 | Kjonaas | 508/154 |
| 4,075,112 | 2/1978 | Van Doorne | 508/534 |
| 4,110,233 | 8/1978 | Bailey et al. | 508/534 |
| 4,352,844 | 10/1982 | Bornstein | 428/35 |
| 4,801,486 | 1/1989 | Quacquarella et al. | 428/34.9 |
| 5,401,546 | 3/1995 | Meattle | 428/35.2 |
| 5,911,665 | 6/1999 | Heydarpour et al. | 428/35.7 |
| 5,948,736 | 9/1999 | Smith et al. | 508/178 |

*Primary Examiner*—Jacqueline V. Howard
*Attorney, Agent, or Firm*—John Lezdey & Assoc

[57] ABSTRACT

A sealed pouch of a single layer polyolefin film having a thickness of from about 0.005 to 0.001 inch and a melting point below about 280° F. which is soluble in a lubricating oil base. The pouch contains a solid lithium hydroxide or lithium fatty acid salt or mixtures thereof for use in preparing greases.

14 Claims, No Drawings

POUCHED INGREDIENTS FOR PREPARING GREASES

BACKGROUND OF THE INVENTION

1. Field of the Invention

The invention relates to an article comprising a pouch of a polyolefin film containing a solid alkaline or alkaline earth metal hydroxide, particularly a lithium hydroxide composition for use in the preparation of lubricating greases.

2. Description of the Prior Art

Lithium complex soaps used as thickening agents for lubricating greases can be prepared by reacting lithium hydroxide monohydrate or other lithium base with aliphatic monocarboxylic and/or dicarboxylic acids which may be saturated or unsaturated, straight or branched chain, and may be hydroxy substituted. Preferably, these acids contain about 6 to 30 carbon atoms and more preferably, from about 6 to 18 carbon atoms. It has long been known that a grease comprising a lithium soap of hydrogenated castor oil, or the lithium soap of 12-hydroxy stearic acid provide greases with exceedingly high mechanical stability and excellent water resistance.

In general, any of the conventional lubricating oils such as mineral, animal, vegetable or synthetic lubrication oils, may be employed as the grease base stock. These lubricating oils have a viscosity in the range of about 35 to 200 SSU at 210° F. Mixtures of lubricating oils may also be effectively utilized. The grease compositions will usually contain about 70 to 95 weight percent, preferably about 80 to 95 weight percent, based on the total grease of the lubricating oil base. The lithium soap content may range from about 5 to 30 weight percent, preferably about 8 to 40 weight percent based on the total grease composition.

Lithium greases may be prepared as follows. The 12-hydroxy stearic acid or hydrogenated castor oil is dissolved in lubricating oil while heating to about 125 to 175° F. at atmospheric pressure. Lithium hydroxide is added to this solution at about 180–190° F., in a stoichiometric amount for complete saponification of the 12-hydroxy stearic acid and to provide a mixture of the lubrication oil and lithium complex soap; heating the mixture until it is uniform at a temperature from about 350° F. to 430° F.; rapidly cooling the mixture to about 300° F. or below by quenching with additional lubricating oil and finally incorporating the remainder of the lubricating oil into the grease composition.

Lithium hydroxide is typically available commercially as the solid monohydrate (Li OH $H_2O$). This solid produces a dust when handled which causes choking and is extremely irritating, even in trace amounts. Anhydrous lithium hydroxide is especially dusty and more expensive to produce. Large amounts of lithium hydroxide monohydrate are used, as described above, in lithium grease manufacturing and the irritating dust is an environmental hazard during handling and mixing operations. Bulk powders of lithium hydroxide monohydrate can easily be spilled by the user, causing waste, as well as possible respiratory irritation. Furthermore, waste can also occur while loading the reactor through spillage, resulting in an insufficient charge, yielding a grease composition below the desired specifications. The granules or powders of lithium hydroxide monohydrate or anhydrous lithium hydroxide also have a tendency to clump and cake after contact with water or when stored in areas of high humidity. This caking diminishes the amount of exposed surface area which can be initially contacted by the lubricating oil base stock during the saponification reaction; thereby slowing the reaction. This caking of the lithium hydroxide thus interferes with dispensing efficiency.

Therefore, a need exists for lithium hydroxide granules or powders to be handled without exposing the user to safety hazards as through dusting, inhalation and spillage.

SUMMARY OF THE INVENTION

In accordance with the invention, the hazardous environmental drawbacks of lithium compositions, useful in the manufacture of lubricating grease compositions, particularly the problems associated with lithium hydroxide compounds, are overcome. Such drawbacks are solved by an article of manufacture comprising a sealed pouch of a polyolefin film substantially soluble in a hot lubricating oil base stock and having melting points below 280° F., enclosing powders, pellets or granules of the lithium compositions.

More specifically, the present invention relates to at least the inclusion of lithium hydroxide or lithium fatty acid soap (salt) in a pouch, which forms by sealing at least one low density polyolefin film selected from polyethylene, polypropylene and copolymers and terpolymers of olefin monomers having a carbon range of at least 2 carbon atoms and mixtures thereof. It is preferable to have the pouch soften and open at about 190° to 205° F. and totally dissolve by 280° F. These polyolefin films have a thickness of from about 0.0005 to about 0.001 inch. It is desirable to minimize the size and thickness of the pouch so as not to affect any grease properties and to disperse completely.

An object of the present invention is to provide granulated lithium hydroxide and lithium fatty acid ester salt compositions for use in lubricating grease compositions by eliminating handling hazards.

Another object of the present invention is to provide a lithium composition useful for lubricating greases, which does not pose safety hazards such as through dusting and spillage.

Another related object of the present invention is to provide a pouch consisting of a polyolefin film enclosing a predetermined amount of lithium hydroxide monohydrate or lithium 12-hydroxy stearate or related compositions or mixtures thereof.

A further object of the present invention is to provide a delivery means to disperse and dissolve lithium in a hydroxide lubricating oil mixture.

A further object of the present invention is to provide a delivery means to disperse and dissolve lithium hydroxide or lithium 12-hydroxy stearate or mixtures thereof in a lubricating oil mixture to enhance lubricating properties.

A more particular object of the present invention is to provide a pouch consisting of a polyolefin film containing a lithium hydroxide composition, which is dissolved without insoluble residue.

These and other objects of the present invention will be apparent from the detailed descriptions herein.

DETAILED DESCRIPTION OF THE PREFERRED EMBODIMENTS

On its broadest aspect this invention is primarily concerned with the safe handling of dry alkaline solids, in the form of powders, pellets or granules. The solids are enclosed in packing consisting of at least one layer of a polyolefin film. More particularly, the present invention is concerned with the safe handling of lithium hydroxide, either in the anhydrous or monohydrate forms, in various commercial manufacturing processes, such as in the production of lubricating greases, glass and ceramics, aluminum metal recovery, in swimming pool sanitizers, primary and secondary lithium batteries, in nuclear energy production, and in pharmaceuticals.

As mentioned hereinbefore, the hazardous problem of handling lithium hydroxide is that it causes choking and is irritating, even in trace amounts and even when invisible amounts of this dust enters the nose or mouth. This has been a long standing difficulty in industrial operations, not only from the human standpoint, but also because of its strong alkaline character the dust interferes with electrical equipment and machinery. It is of particular interest according to this invention to provide a delivery means for charging a reaction vessel with dry alkaline solids such as lithium hydroxide (in either form) and other lithium solutions to a lubricating base stock. Other lithium additives include lithium complex soaps in the production of which lithium hydroxide is a precursor.

For this purpose, a pouch enclosing these lithium compounds is provided which is made of a low density polyolefin polymer which melts below 280° F. and softens at about 140 to 200° F., is inert to the lithium composition contents as well as the lubricating grease reactants, rapidly dissolving into the grease composition mixture with substantially no residue, dispenses the contents and does not change any characteristics of the final grease composition. This is the crux of the present invention.

The present invention describes a unique article of manufacture which comprises a packaging means containing a prescribed amount of a lithium compound encased in a sealed pouch which consists of a film of a low melting polyolefin such as a low density polyolefin, low density polypropylene, low density polyethylene, copolymers and terpolymers of ethylene with other olefins having carbon atoms within the range of about 2 to 5 with the above described melting and softening parameters. The packaging means may be in the form of a bag, envelope, pocket or pouch. For example, the pouch may be formed by placing two low-density polyethylene films against each other and heat-sealing on the three adjacent edges along the perimeter leaving an opening to add a prescribed amount of the lithium composition. After filling, the remaining opening is closed preferably by heat sealing or by any conventional closure means.

As will be appreciated by those skilled in the art, various closing operations can be applied to the thereby formed pouch to provide a flat bottom. In a preferred embodiment, the pouch is formed into a rectangular configuration in which the sheet of film is folded around a rectangular mandrel and the three sides and the open side are heat sealed after loading with the proper lithium compound.

The packaging means or pouch may consist solely of the film, in particular a single layer film. This is in particular when the case is stored in a dry place. It is, however, also possible that the pouch film is covered with a watertight, puncture resistant wrapping on the outside enclosing the pouch, which protects it from moisture penetration. This protective wrapping may be made to be easily opened and removed before adding the pouch to the reactor.

It is also desirable to use as little polyolefin films as possible in making the pouch so as not to affect any properties of the grease composition. For example, a 6 mil low density polyetheylene bag has sufficient strength to hold about 25 kilograms of lithium hydroxide monohydrate, withstand the demands of handling and transport and have the melting and softening characteristics required.

In addition to the health benefits provided to operators by making the environment in the workplace safer, the pouches of predetermined amounts of lithium compound are convenient, i.e., not requiring hazardous material suits, reducing the chances of error in the amount of material to be added to the reactor and eliminating spillage.

For the purpose of this disclosure the term "lithium composition" includes lithium hydroxide (both forms) and lithium fatty acid salts (as defined below) and mixtures thereof.

In a grease manufacturing operation, the use of a pouch containing a prescribed amount of a lithium compound involves merely tossing the predetermined number of pouches into a reactor containing a lubricating oil based stock. After all the pouches have been furnished, the reactor is closed, the agitation and heating begin, the pouch softens and opens allowing the lithium compound to mix and disperse throughout the base stock. It is desirable to have the bag soften and open at about 190° to 205° F. and completely melt by 200° F. In the case of lithium hydroxide, it does react with the fatty acid esters which are pre-charged into the reactor until the temperature of about 190° is attained. The pouch is designed to completely melt so that at the grease processing temperatures (290° to 300° F.) there is no residue in the grease upon cooling.

The hydroxy fatty acid employed in preparing the grease compositions useful in this invention will have about 12 to 24, preferably about 16 to 20 carbon atoms. Preferred are hydroxystearic acids and esters of these acids such as 9-hydroxy, 10-hydroxy or 12-hydroxy, stearic acid and most preferably 12-hydroxy stearic acid. Other acids include ricinoleic acid (castor oil), 12-hydroxy tetradecanoic acid, 10-hydroxy tetradeconoic acid, 12-hydroxy hexadecanoic acid, 8-hydroxy hexadecanoic acid, 12-hydroxy icosanic acid, 16-hydroxy icosanic acid and esters thereof.

Various other additives may be incorporated into the pouch which could be added to the grease composition as understood by those skilled in this art so long as these components are not interactive below the grease processing temperature. Such additives include, but are not limited to dyes, anti-oxidants, rust inhibitors, odor modifiers, extreme pressure agents and the like.

The following examples show the production of grease compositions using the packaging technique of the present invention.

EXAMPLE 1

240 g. of paraffinic oil(HC-750, Chemtool) were heated to 60° C. with stirring and then 36.1 g. of 12-hydroxy stearic acid (Cenwax A- Union Camp) were added. The stearic acid dissolved at about 85° C. and then a completely sealed low density polyethylane bag containing 5.0 g. of lithium hydroxide monohydrate was thrown into the hot oil which was being heated. The plastic bag began to soften about 90–95° C. and the lithium hydroxide was dispersed throughout the oil by 100° C. while the plastic bag had completely dispersed in the oil. 30 ml of water was then slowly and carefully added to the stirred slurry to facilitate the reaction between the 12-hydroxystearic acid and the lithium hydroxide monohydrate. The temperature was slowly raised to 125° C. over two hours to complete the reaction. The temperature was then rapidly raised to 200° C. and the rest of the paraffinic oil was then added. The hot grease was cooled and milled. The grease was clear and the low density polyethylene bag had completely dissolved/dispersed. (The working penetration of the grease was that of a very heavy NLGl No. 2 grade of a lithium-based grease, exactly as expected.)

EXAMPLE 2

358.9 g. of paraffinic oil (HC-750, Chemtool) were heated to 85° C. with stirring and then a completely sealed low density polyethylene bag containing 36.9 g. of lithium 12-hydroxystearate was thrown into the hot oil which was being heated. The plastic bag began to soften about 90–95° C. and the lithium 12hydroxystearate began dissolving and dispersing throughout the oil by 100° C. while the plastic bag had completely dispersed in the oil. The temperature was raised to 200° C. over one hour to completely dissolve all ingredients. The hot grease was cooled and milled. The grease was clear and the low density polyathylene bag had completely dissolved/dispersed. (The working penetration of the grease was that of a very heavy NLGl No. 2 grade of a lithium-based grease, exactly as expected.)

While we have described the invention with particular reference to certain preferred embodiments thereof, it is to be understood that those are by no means to be understood as any limitation within the scope of the invention when understood by those skilled in the art.

What is claimed is:

1. An article comprising a sealed pouch of a single layer polyolefin film having a thickness of from about 0.005 to 0.001 inch and a melting point below about 280° F. which is soluble in a lubricating oil base, said pouch containing a solid lithium hydroxide or lithium fatty acid salt or mixtures thereof.

2. The article according to claim 1 wherein said pouch consists of a polyolefin film which melts below about 230° F.

3. The article according to claim 1 wherein said pouch consists of a polyolefin film which softens within a temperature range of between about 190° to 200° F.

4. The article according to claim 1 wherein said lithium hydroxide is selected from anhydrous lithium hydroxide or lithium hydroxide monohydrate.

5. The article according to claim 1 wherein said lithium fatty acid salts are selected from saturated or unsaturated straight or branch -chain aliphatic monocarboxylic and dibasic organic acids having about 6 to 30 carbon atoms.

6. The article according to claim 5 wherein said lithium fatty acid salt is lithium 12-hydroxy stearate.

7. The article according to claim 5 wherein said lithium fatty acid salt is lithium ricinolate.

8. The article according to claim 1 wherein said solid lithium hydroxide or lithium fatty acid salt or mixture thereof are in the form of powders, pellets or granules.

9. The article according to claim 1 wherein the pouch is dissolved in a hot lubricant oil base stock with a residue less than 0.02 weight percent.

10. The article according to claim 1 wherein said polyolefin film is selected from low density polyethylene, low density polypropylene copolymers and terpolymers of olefin monomers having a carbon range of about 2 to 5 carbon atoms and mixture thereof.

11. The article according to claim 1 wherein said pouch is heat sealed.

12. The article according to claim 1 wherein said pouch comprising said film and a covering of a film which protects against entering of moisture.

13. A method of preparing a lubricating grease compostion which comprises adding to lubricating oil at elevated temperatures the article of claim 1.

14. A method of preparing a lubricating grease composition which comprises the steps of:

a) charging a predetermined amount of lubricating oil base stock to a vessel b) adding the article of claim 1 containing a prescribed amount of the lithium composition c) heating and mixing the mixture of step b to a temperature sufficient to melt said article to dispense the contents thereof d) heating and mixing the mixture of step b to melt and disperse contents throughout the lubricating oil base stock to form a liquid grease, e) cooling said liquid to form a solid state grease composition.

* * * * *